United States Patent [19]

Hansen

[11] Patent Number: 4,756,469

[45] Date of Patent: Jul. 12, 1988

[54] MULTI-COMPARTMENT CONTAINER

[75] Inventor: Gerald M. Hansen, Maumee, Ohio

[73] Assignee: Nekoosa Packaging Corporation, Toledo, Ohio

[21] Appl. No.: 17,395

[22] Filed: Feb. 24, 1987

[51] Int. Cl.[4] ..... B65D 5/48

[52] U.S. Cl. ..... 229/120.25; 229/120.26; 229/120.31; 229/120.37

[58] Field of Search ..... 229/15, 27, 28 R; 229/120.26, 120.25, 120.31, 120.37

[56] References Cited

U.S. PATENT DOCUMENTS

| | | | |
|---|---|---|---|
| 1,157,712 | 10/1915 | Miller | 229/15 |
| 1,213,455 | 1/1917 | Burke | 229/27 |
| 2,154,085 | 4/1939 | Bergstein | 229/28 R |
| 2,693,297 | 11/1954 | Bolding | 229/52 B |
| 2,706,037 | 4/1955 | Feigelman | 229/28 R |
| 2,794,586 | 6/1957 | Broderick | 229/27 |
| 3,039,672 | 6/1962 | Kuchenbecker | 229/28 R |
| 3,871,569 | 3/1975 | Wharton, Jr. | 229/15 |
| 3,985,286 | 10/1976 | Hicks | 229/15 |
| 4,226,357 | 10/1980 | Martin | 229/15 |
| 4,417,684 | 11/1983 | Skaggs | 229/15 |

*Primary Examiner*—Stephen Marcus
*Assistant Examiner*—Gary E. Elkins
*Attorney, Agent, or Firm*—John R. Nelson

[57] ABSTRACT

A multi-compartment carton or container formed from a single blank of sheet material which is cut, scored, folded and glued in a fashion such that it is in a collapsed or "knock-down", ready-for-shipping condition upon being formed and is thereafter easily erected for use.

15 Claims, 5 Drawing Sheets

MULTI-COMPARTMENT CONTAINER

BACKGROUND OF THE INVENTION

1. Field of the Invention

This invention relates generally to cartons and, more particularly, to multi-compartment containers made from a single blank of material. The blank is uniquely cut, scored, folded and glued in a fashion such that is in a flat or collapsed condition for shipping to a user. The carton is then easily erected by the user and ready to receive items in the compartments.

2. Description of the Prior Art

There are many types of cellular cartons presently available which can be used to package items. Examples of such cartons are disclosed in U.S. Pat. Nos. 3,006,529; 3,039,672; 3,425,616; 3,825,174; 3,977,592 and 4,377,252. However, each of the prior art cartons need improvement in one or more areas.

For example, many of the cartons need substantial increases in top to bottom compression strength to enable better stacking of the units. Some of the cartons are difficult to erect and require expensive manual assistance to erect. Still others cannot be knocked-down or flat-folded in a collapsed configuration for shipping or storage. All have high cost, either in material or assembly time, in order to attempt to meet the advantages of the present invention. None provide the alternatives for manufacturing cartons which gives the opportunity for providing the cartons with different numbers of cells or, compartments while still following the same basic manufacturing process.

SUMMARY OF THE INVENTION

An improved collapsible multi cell or multi-compartment carton formed from a single sheet or blank is disclosed which includes a pair of outer side panels and extension means for each of the opposite edges of each of the outer side panels. The side panels and associated extension means are formed in an aligned relationship in a single blank of material on opposite sides of a cut line in the blank.

Each of the extension means for each outer side panel includes a successively hinged end panel and connecting panel. At least one of the extension means for each outer side panel further includes a successively hinged partition panel and an adhesion panel attached to the connecting panel of that extension means. Hinge means are provided by interrupting the cut line between connecting panels of the extension means, thereby securing together the cut line edges of the connecting panels located on opposite sides of the cut line.

The extension means on opposite edges of each outer side panel are folded toward each other along the hinge between the end panel and the connecting panel. The adhesion panel of each extension means is adhered to their associated outer side panels. The outer side panels are then folded toward each other along the cut line and held in a collapsed configuration by adhering facing connecting panels together.

By thus using only one set of a successively hinged partition panel and an adhesion panel per each outer side panel, and properly dimensioning all panels a carton is manufactured which when erected would provide a four cell container. Moreover, this is the generic embodiment upon which the other embodiments are based.

In a second embodiment of this invention a collapsible multi-compartment container includes a pair of outer side panels. An end panel, a connecting panel, a partition panel and an adhesion panel are consecutively hinged from and extend from opposite ends of each of the outer side panels.

The outer side panels and consecutively hinged panels attached thereto are formed in an aligned relationship in a single sheet of material on opposite sides of a cut line in the sheet. The cut line is interrupted by hinge means between aligned connecting panels.

The connecting panel, partition panel and adhesion panel on each side of each outer side panel are folded toward each other along the hinge between connecting and end panels, and are adhered to the outer side panel along each adhesion panel. The outer side panels are then folded toward each other along the cut line and held in a collapsed configuration by adhering facing connecting panels together. The collapsed configuration is erected into a multi-compartment configuration by forcing outer edges of opposing end panels toward each other.

The just-defined embodiment can be erected into a three cell (one larger and two smaller cells) or a five cell (one larger and four smaller cells) configuration. Divider panels may be added in the three and five cell configurations to provide four and six cell configurations, respectively.

In a still further embodiment of the teachings of this invention a collapsible multi-compartment container may be formed from a single sheet of material. This embodiment includes a pair of outer side panels and an extension means for the opposite edges of each of the outer side panels. Two extension means for one of the outer side panels, and one of the extension means for the other of the outer side panels, each include an end panel, a connecting panel, a partition panel and an adhesion panel consecutively hinged from the two edges of the one outer side panel and one edge of the other outer side panel. The extension means for the remaining opposite edge of the other outer side panel includes an end panel, a connecting panel, a partition panel, panel means for dividing a middle larger cell into two smaller cells, means for adhering the partition panel to said other outer side panel, and means for attaching said divider panel means to one of the panels extending from the other edge of the said other outer side panel when the two extension means for said other outer side panel are folded toward each other.

This application also discloses use of a divider panel means for manual or machine insertion in the larger cell in the opposing slots formed between aligned and adjacent connecting panels when the collapsed container is erected. Thus, there is generically disclosed herein additional panel means for dividing the largest compartment of an erected container into two smaller compartments, with two specific examples being described.

As in the other embodiments, the outer side panels and the extension means associated therewith are formed in a single sheet of material on opposite sides of a cut line in the sheet, with the cut line being interrupted by hinge means between aligned connecting panels of the extension means.

All of the above—described embodiments may have bottom closure panel means hingedly connected to at least one of the outer side panels. The bottom panel closure means may include a bottom flap hinged to each of the outer side panels on the edge opposite to the cut line. Additional bottom panel closure means may be hinged to at least two of the end panels on the edges thereof opposite to the cut line, and also may be hinged to each of the end panels.

The additional bottom panel closure means may also include a bottom flap hinged to each of the end panels on opposite sides of one of the outer side panels. In this instance each bottom flap may extend laterally past the hinged connection to its associated end panel to a position adjacent a connection panel which is hinged to the associated end panel, thereby enabling these bottom flaps to extend beneath adjacent end compartments when the single sheet is folded and erected into a multi-compartment container.

The additional bottom panel closure means may alternatively include a bottom flap hinged to an end panel on one side of a first of the outer side panels, and a bottom flap hinged to an end panel on the opposite side of the second of the outer panels. Each of these bottom flaps may extend laterally past the hinged connection to its associated end panel to a position adjacent a connection panel which is hinged to the associated end panel, thereby enabling the bottom flaps to extend beneath adjacent end compartments on opposite ends of the carton when the single sheet is folded and erected into a multi-compartment carton.

It is an object of this invention, therefore, to provide an improved multi-cell carton which is less expensive to manufacture and assemble than known similar cartons, but which still increases top-to-bottom compression strength to enable better stacking and handling.

It is a further object of this invention to provide a multi-cell carton design which may be used to manufacture cartons with different numbers of cells while still using the same basic manufacturing techniques.

It is a still further object of this invention to provide a multi-cell carton in which the folding and gluing operations have been reduced to the lowest number possible and still attain the advantages desired.

Other objects, advantages and features of this invention will become apparent when the following description is taken in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENTS

Figure 1:
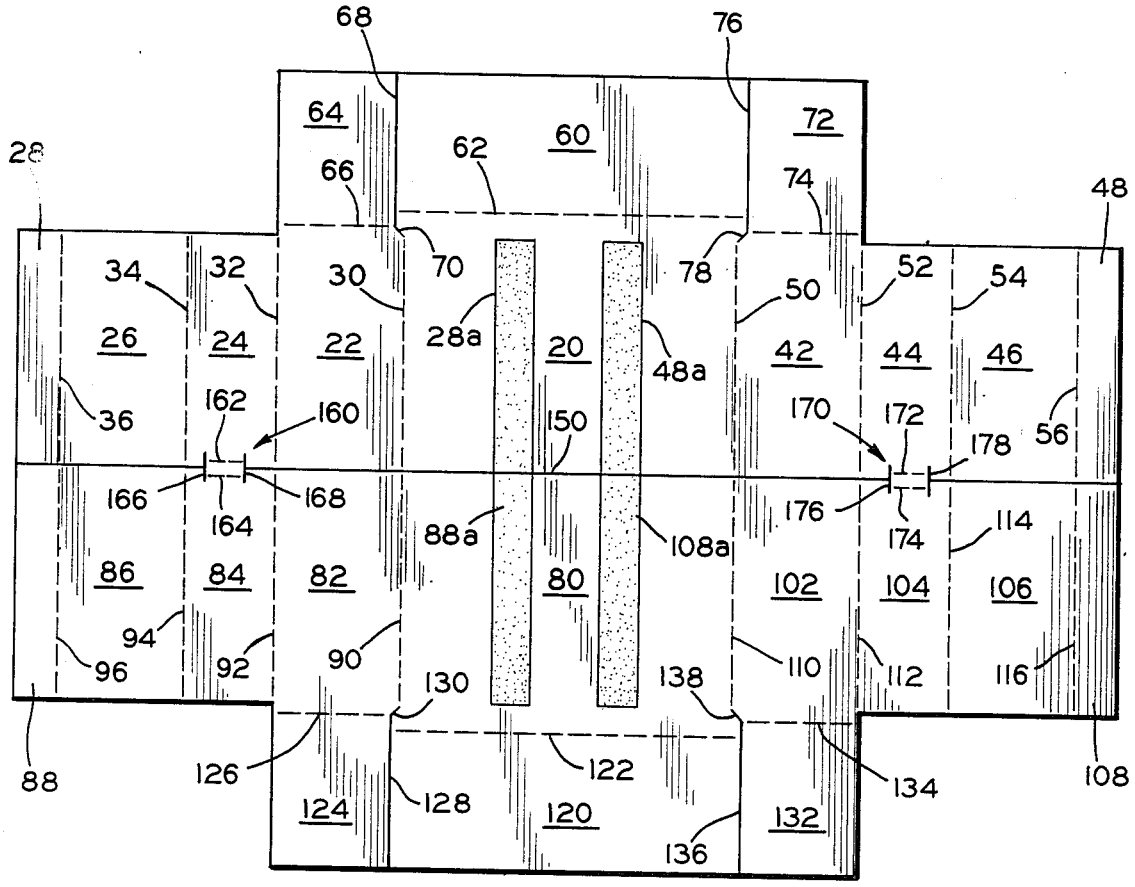
FIG. 1 is a plan view of the carton blank from which a first embodiment of the cellular carton is formed.
Figure 2:
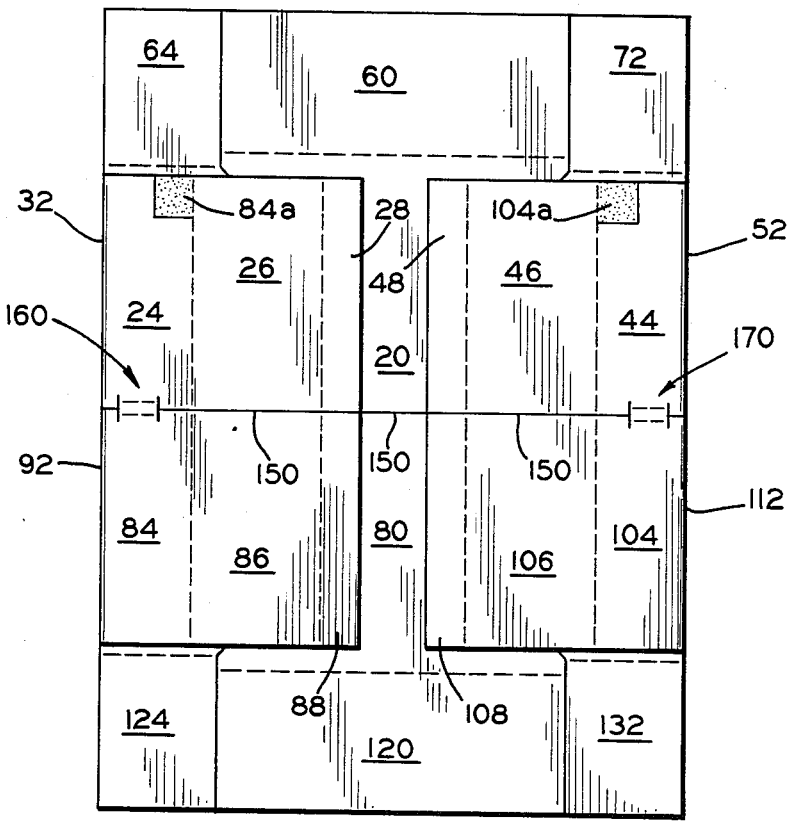
FIG. 2 is a view of the carton blank illustrated in FIG. 1 after a first folding operation.
Figure 3:
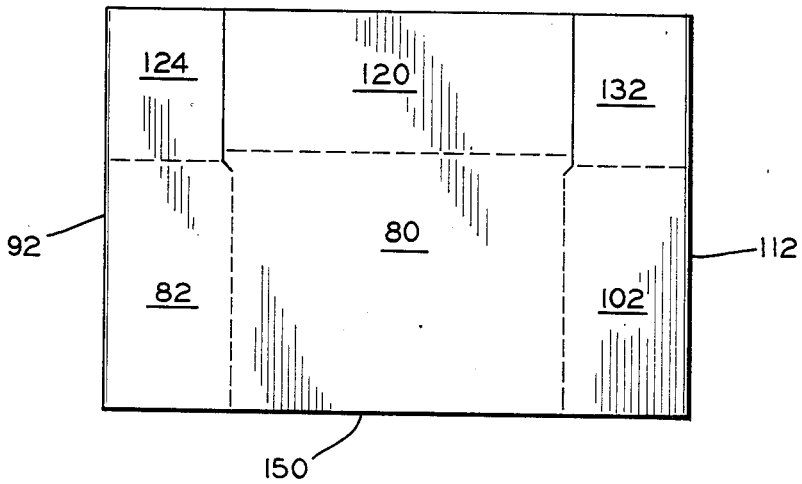
FIG. 3 is a view of the carton blank illustrated in FIG. 2 after a second folding operation.

Referring now to FIGS. 1 to 3 there is illustrated a first embodiment of the teachings of this invention in which a multi-cell container is formed from a single blank of suitable material, such as corrugated box board with the corrugations aligned in the short direction.

The blank is suitably cut and scored to provide a first outer side panel 20. Successively hinged to one edge of side panel 20 is left end panel 22, left connecting panel 24, left partition panel 26 and left adhesion panel 28. The panels in this left extension means are joined to side panel 20 by hinge score lines 30, 32, 34 and 36, respectively. Similarly, a right extension means includes right end panel 42, right connecting panel 44, right partition panel 46 and right adhesion panel 48 all joined to side panel 20 by hinge score lines 50, 52, 54 and 56, respectively.

A matching outer side panel 80 plus left and right extensions therefrom is formed in an aligned relationship with corresponding panels on the opposite side of cut line 150 extending longitudinally through the blank. Successively hinged to one edge of side panel 80 is left end panel 82, left connecting panel 84, left partition panel 86 and left adhesion panel 88. The panels in this left extension means are joined to side panel 80 by hinge score lines 90, 92, 94 and 96, respectively. Similarly a right extension means for panel 80 includes right end panel 102, right connecting panel 104, right partition panel 106 and right adhesion panel 108 all joined to side panel 80 by hinge score lines 110, 112, 114, and 116, respectively.

Bottom closure panel means are hingedly connected to at least one of the outer side panels. In the embodiment illustrated in FIGS. 1 to 3 a main or lengthwise side bottom flap 60 is connected to side panel 20 along hinge score line 62, while end bottom flaps 64 and 72 are connected to end panels 22, 42 by hinge score lines 66, 74 and separated from the side bottom flap 60 by cut lines 68 and 76, respectively.

Similarly, a main or lengthwise side bottom flap 120 is connected to side panel 80 along hinge score line 122, end bottom flaps 124, 132 are connected to end panels 82, 102 along hinge score lines 126, 134 and separated from flap 120 by cut lines 128 and 136 respectively.

Offsets 70, 78, 130 and 138 in cut lines 68, 76, 128, and 136 permit folding of flaps 64, 72, 124, and 132 inside of outer side panels 20 and 80. It should be noted that the relative dimensions shown in the drawings herein have been exaggerated where necessaty to clarify operations or features of the invention and may not be followed exactly on an actual production set-up. For example, hinge means indicated generally at 160, 170 which interrupt cut line 150 to join together the cut line edges of connecting panels 24, 84 and 44, 104 may have relative dimensions that are different in actual production. Hinge 160 includes score lines 162, 164 with vertical cut lines 166, 168 defining the end of the hinge. Similarly, hinge 170 includes score lines 172, 174 with vertical cut lines 176, 178 defining the end of the hinge. As will also be appreciated by those skilled in the art, the dimensions of the various panels may be changed in order to provide cells or compartments which are of a desired size.

After the blank is manufactured, that part of the extension means on each side of each outer side panel on the outside of score lines 32, 52, 92 and 112 is folded toward the middle of the respective outer side panels. That is, the connecting panel, partition panel and adhesion panel of each extension means is folded along the hinge score lines just noted so that glue flaps 28, 48, 88 and 108 overlie the glue areas **28*a*, 48*a*, 88*a* and 108*a* noted in FIG. 1, and are adhered to the outer side panels to provide the folded configuration illustrated in FIG. 2**.

The outer side panels 20, 80 are then folded toward each other, with the previously folded extension means therebetween, along the cut line 150 on hinges 160, 170, as shown in FIG. 3. The carton is retained in this folded, collapsed condition by applying adhesive to the glue areas **84*a*, 104*a* on connecting panels 24, 44 so that when connecting panels 84, 104 are folded over with outer side panel 80, the connecting panels 84, 104 are adhered to connecting panels 24, 44. Each end of the pairs of connecting panels 24, 84 and 44, 104 are thus held together by glue at one end and the hinges 160, 170** at the other end, enabling each pair to act as a single unit.

Figure 4:
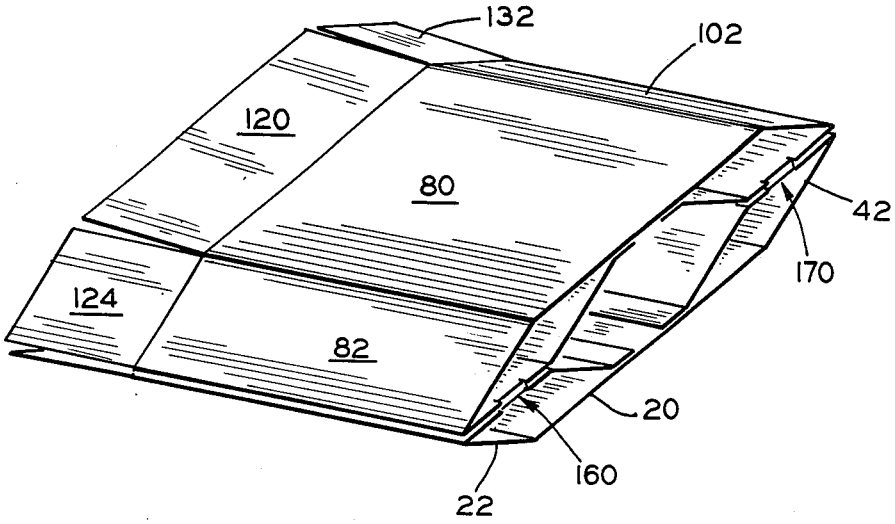
FIG. 4 is a line drawing schematically illustrating in perspective a partially erected carton.
Figure 5:
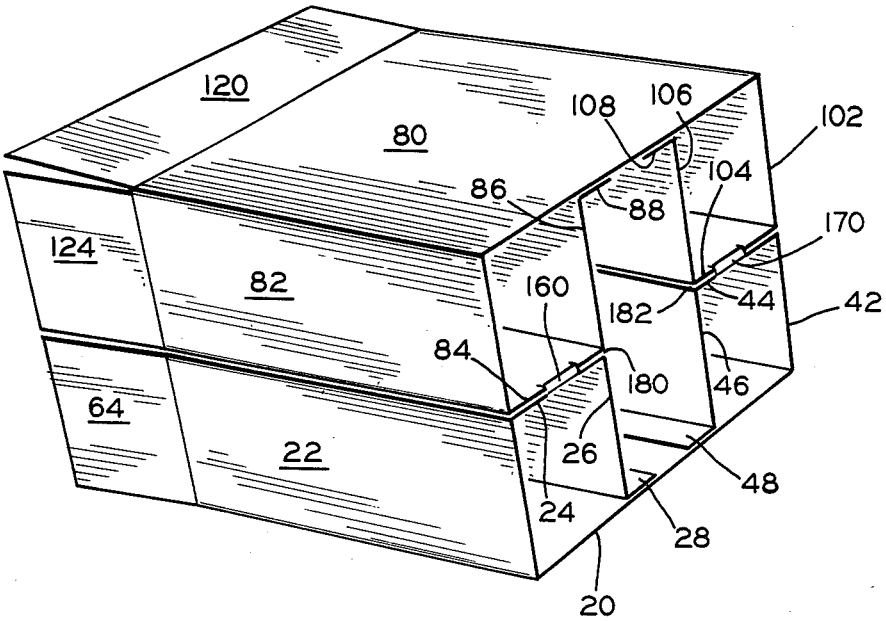
FIG. 5 is a line drawing schematically illustrating in perspective a fully erected carton with five cells.

Referring now to FIG. 4 it can be seen that the collapsed carton can be erected by forcing outer edges of the end panels toward each other. As previously noted the pairs of connecting panels 24, 84 and 44, 104 are acting as units, and therefore transmit the force applied to edges of the end panels to the hinged score lines of the partition panels as the end panels fold outwardly away from each other. This lifts the outer side panels away from each other, pulling the partition panels into position by their hinged connected to the glue flaps, so that the carton is then fully erected as shown in FIG. 5. The carton may be maintained in the erected position by gluing or otherwise securing the bottom flaps together in a manner known in the art to give unitary strength and rigidity to the erected carton.

Figure 9:
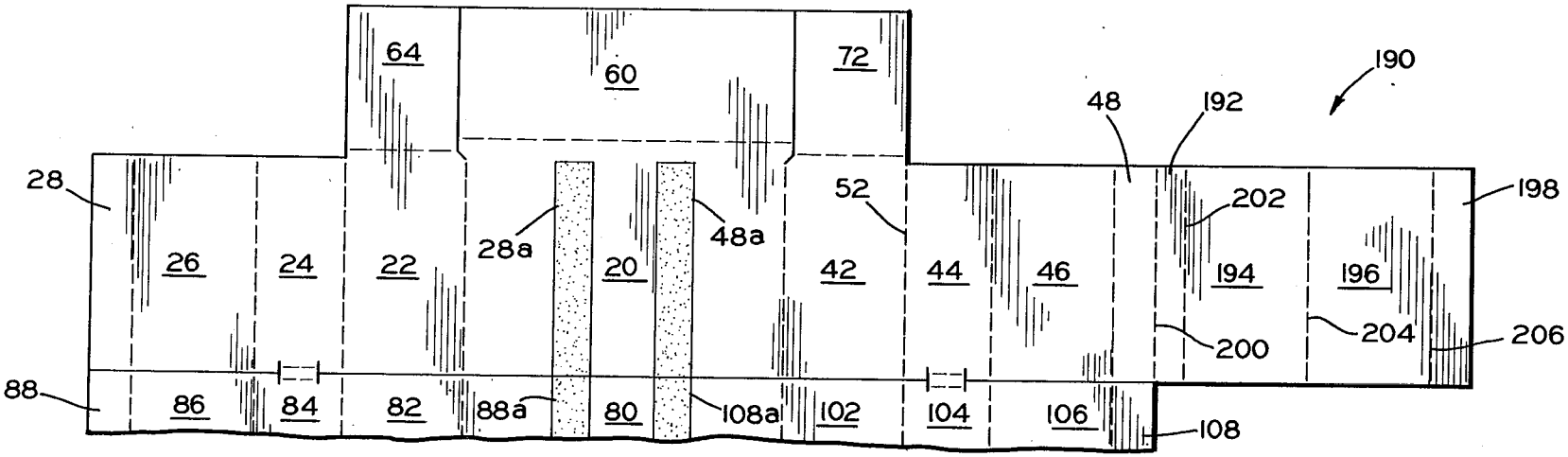
FIG. 9 is a plan view of a carton blank illustrating an embodiment for dividing the larger cell into two smaller cells.
Figure 11:
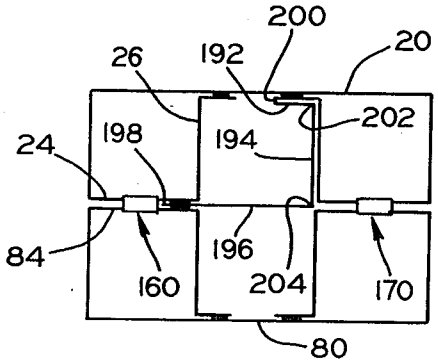
FIG. 11 is a line drawing schematically illustrating a top view of the embodiment of FIGS. 9 and 10 which is erected to provide a carton with six cells or compartments.
Figure 10:
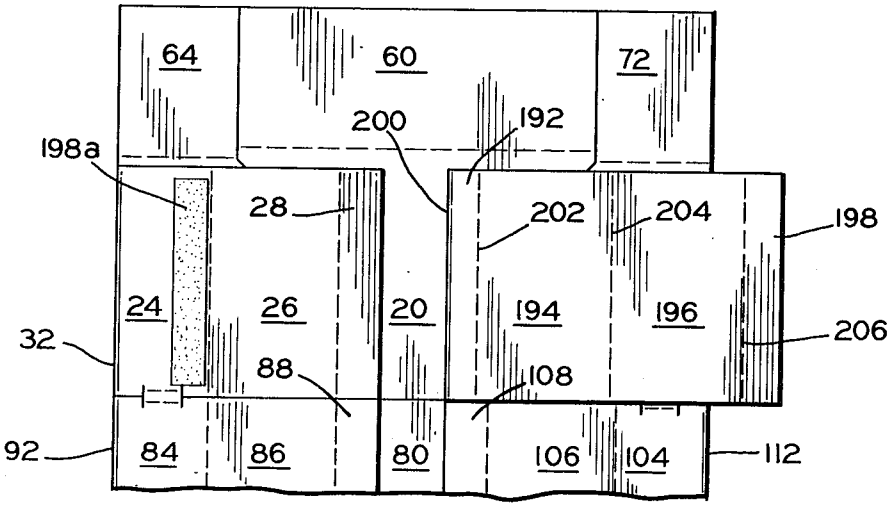
FIG. 10 is a view of the carton blank illustrated in FIG. 9 after a first folding operation.

The five cell carton illustrated in FIG. 5 may be easily converted to a six cell carton by the manual or machine insertion of a divider panel into and extending between the slots 180, 182 formed between the pairs of connecting panels 24, 84 and 44, 104. Another structure and method for converting the five cell configuration to six cells is shown in FIGS. 9 to 11, and will be described hereinafter.

Figure 6:
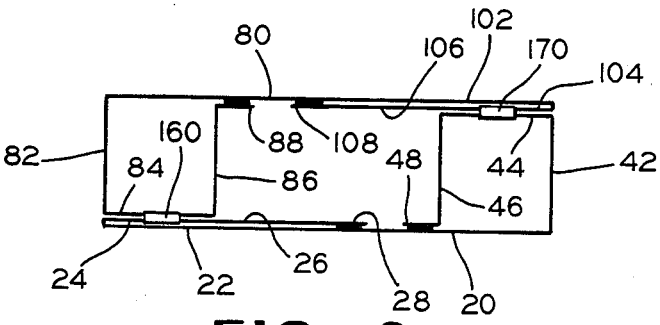
FIG. 6 is a line drawing illustrating a top view of the embodiment of FIG. 3 which is erected in a manner to provide a carton with three cells.

Referring now to FIG. 6 it can be seen that the folded or collapsed configuration shown in FIG. 3 can be erected to a three cell carton. By retaining one of the end panels (manually or by machine) at each side next to its associated pair of connecting panels, while moving the pairs of connecting panels toward each other, the carton will erect in the three cell configuration shown in FIG. 6. The carton may be maintained in the three cell configuration by properly securing the bottom flaps together.

In addition to the three, five and six cell configurations previously discussed, the same basic manufacturing process may be used to provide a four cell configuration. To do this, a blank similar to that shown in FIG. 1 is manufactured, except that aligned pairs 26, 86 and 28, 88 of partition and adhesion panels are omitted. Further, the dimensions are changed, e.g. by reducing the width of the outer side panels, so that when the carton is erected the larger middle cell is eliminated and the unitary pair 24, 84 of connecting panels extends toward and touches its opposing unitary pair 44, 104 of connecting panels to provide a four cell carton. All other manufacturing operations remain the same.

Figure 7:
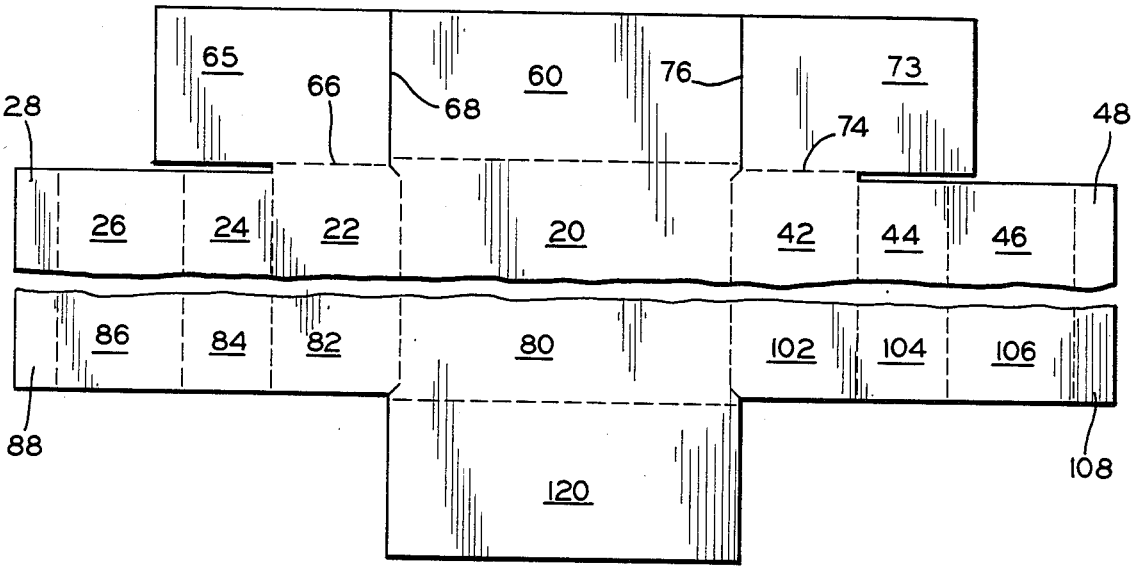
FIG. 7 is a plan view of a carton blank illustrating a second embodiment of a bottom closure panel arrangement.

Referring now to FIG. 7, there is illustrated a second embodiment of the bottom closure panel means. Since the remainder of the blank is identical to the embodiment illustrated in FIG. 1 only the changes in the bottom closure panel means is shown. The bottom end flaps 124, 132 attached to end panels 82, 102, respectively have been eliminated. Instead new bottom flaps 65, 73 have been substituted for the bottom flaps 64, 72 of FIG. 1. The bottom flaps 65, 73 extend laterally past the hinge connections 66, 74 to the associated end panels 22, 42 to a position adjacent the connection panel 24, 44 which is hinged to an associated end panel 22, 42, respectively. This structure enables the bottom flaps 65, 73 hinged to each of the end panels on opposite sides of one of the outer side panels to extend beneath both of the adjacent end compartments at each end of the compartment for securing.

Figure 8:
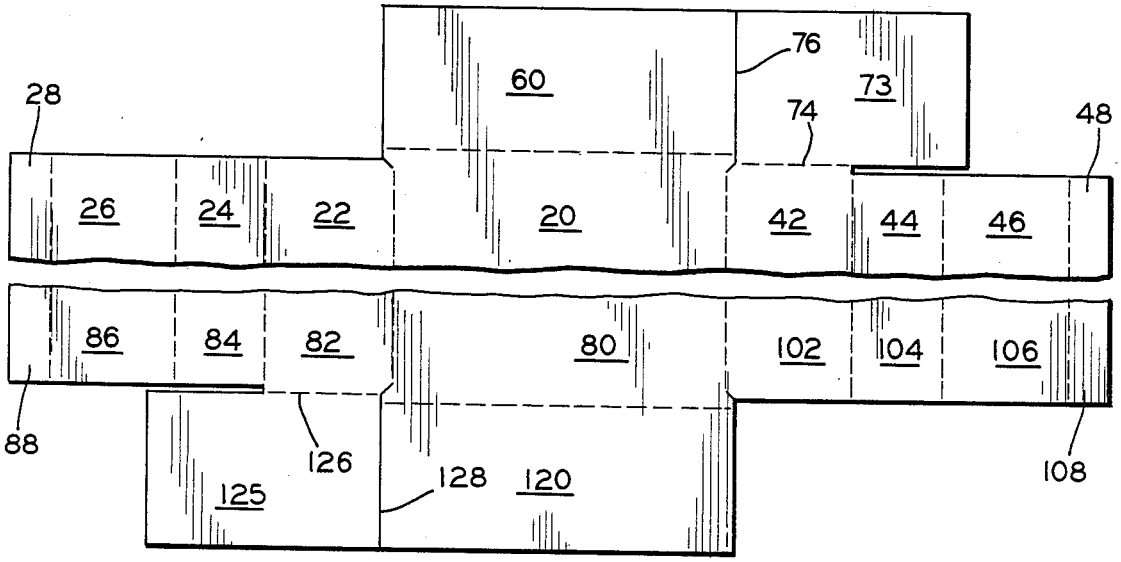
FIG. 8 is a plan view of a carton blank illustrating a third embodiment of a bottom closure panel arrangement.

Referring now to FIG. 8 there is illustrated a third embodiment of the bottom closure panel means. Again, since the remainder of the blank is identical to the embodiment illustrated in FIG. 1 only the changes in the bottom closure panel means is shown. The bottom end flap 64 attached to end panel 22, and the bottom end flap 132 attached to end panel 102 have been eliminated. The new bottom flap 73 has been substituted for the bottom flap 72 of FIG. 1. Similarly, a new bottom flap 125 has been substituted for the bottom end flap 124 of FIG. 1.

The structure remaining, then, includes a bottom end flap 73 hinged to an end panel 42 on one side of a first of the outer side panels 20, and a bottom end flap 125 hinged to an end panel 82 on the opposite side of the second of the outer side panels 80. Each of the bottom end flaps 73, 125 extends laterally past the hinged connection 74, 126 to its associated end panel 42, 82 to a position adjacent a connection panel 44, 84 which is hinged to the associated end panel 42, 82. This structure enables single bottom end flaps to be disposed at each end of the carton which will extend beneath adjacent end compartments at each end of the carton.

Referring now to FIGS. 9 to 11 there is illustrated another embodiment of the invention in which the same basic manufacturing process is utilized to provide a six cell carton or container. Since all of this embodiment is identical to that illustrated in FIG. 1, except for the additional panel means indicated generally at 190, only the parts necessary to illustrate the connection and assembly of the panel means 190 are illustrated.

The additional panel means 190 includes panel means for dividing a middle large cell into two smaller cells and comprises in this embodiment a support panel 192, a connecting panel 194, a partition panel 196 and an adhesion panel or glue flap 198. These panels are successively hinged from the glue flap 48 by hinged score lines 200, 202 and 204, respectively, with the glue flap 198 being connected by a hinged score along line 206 if the glue flap is to be connected in a position other than as a straight extension of partition panel 196.

The entire structure can be described as a pair of outer side panels, and an extension means for the opposite edges of each of the outer side panels. The two extension means for one of the outer side panels 80 and one of the extension means for the other of the outer side panels 20 each include end panels 82, 102, 22; connecting panels 84, 104, 24; partition panels 86, 106, 26; and adhesion panels 88, 108, 28 consecutively hinged from the two edges of the one side panel 80 and the one edge of the other side panel 20, respectively.

The extension means for the remaining opposite edge of the other side panel 20 includes an end panel 42, a connecting panel 44, a partition panel 46, panel means 190 for dividing a middle larger cell into two smaller cells, glue flap means 48 for adhering partition panel to the other outer side panel 20, and panel means 198 for attaching the divider panel means to one of the panels 24, 26 extending from the other edge of the other outer side panel 20.

The specifics of the above generic description include a divider panel means having a support panel 192 hinged to the adhesion panel 48. The extension means are all folded toward the middle of the outer side panels in the same fashion as they are in FIG. 1, with the glue flaps 28, 48, 88 and 108 adhered to side panels 20, 80 at glue areas **28*a*, 48*a*, 88*a* and 108*a*, respectively. The divider panel means 190 is folded back to the right on hinged score line 200 as shown in FIG. 10. The divider panel means 190 is then folded to the left on hinged score line 202, with the divider panel means 190 then having its glue flap 198 being adhered to glue area 198*a* on connecting panel 24**.

Referring now to the schematic line drawing in FIG. 11 it can be seen that force applied to opposite pairs of end panels will erect the carton as previously shown in FIGS. 4 and 5. During the carton erecting procedure the divider panel means 190 will fold at score lines 202 and 204 to position the partition panel 196 to divide the middle larger cell into two smaller cells.

Although FIG. 11 shows the glue flap 198 positioned between and adhered to the unitary pair of connecting panels 24, 84, an alternative solution would be to hinge score the line 206, fold the flap 198 under, and glue the under side of the flap 198 to the left extremity of the partition panel 26. The carton will erect the partition panel 196 into the same position as shown in FIG. 11. It should be noted that lock notches approximately one-eighth inch wide may be formed between flaps 28, 82 and 48, 108 and between panels 26, 86 and 46, 106 to better hold the sides together during gluing operations.

As noted hereinafter, the invention shown and described is to be taken as illustrative only, and changes in the shape, size and arrangement of the components, parts or portions may be made while achieving the same effect without departing from the spirit and scope of the invention.

I claim:

1. A collapsible multi-cell carton, comprising;

(a) pair of outer side panels each having a pair of opposed edges, (b) extensions for each of the opposite edges of each of said outer side panels, each extension including an end panel hinged to an edge and a connecting panel hinged to said end panel, (c) said outer side panels and said extensions associated with each side panel being formed in an aligned relationship in a single blank of material on opposite sides of a cut line formed in said blank, (d) at least one of said extensions for each outer side panel further including a successively hinged partition panel and an adhesion panel attached to a connecting panel of that extension in that order, (e) means interrupting said cut line for hinging together the cut line edges of said connecting panels of said extensions on opposite sides of said cut line, (g) said extensions on said opposite edges of each outer side panel being folded toward each other along said hinges between said end panels and said connecting panels, said adhesion panels of said extension means then being adhered to their associated outer side panel, (h) said outer panels then being folded toward each other along said cut line and held in a collapsed configuration by adhering facing connecting panels together, and (i) means hinged from at least one of said outer side panels for closing a bottom of cells formed when the collapsed configuration is erected into a carton.

2. A collapsible multi-compartment container, comprising;

(a) a pair of outer side panels each having a pair of opposed edges, and (b) left and right extensions for each of said outer side panels, each extension including an end panel, a connecting panel, a partition panel and an adhesion panel consecutively hinged to each other with said end panel hinged to and extending from one of said opposite edges of each of said outer side panels;

(c) said outer side panels and consecutively hinged panels attached thereto being formed in an aligned relationship in a single sheet of material on opposite sides of a cut line in said sheet, said cut line being interrupted by hinges between aligned connecting panels, (d) said connecting panel, partition panel and adhesion panel of each extension of each outer side panel being folded toward each other along the hinge between connecting and end panels of each extension and adhered to the outer side panel along each adhesion panel, (e) said outer side panels then being folded toward each other along said cut line and held in a collapsed configuration by adhering facing connecting panels together, the collapsed configuration being erected into a multi-compartment configuration by forcing said hinges between folded connecting and end panels toward each other.

3. A collapsible multi-compartment container as defined in claim 2 which further includes panel means hingedly connected to at least one of said outer side panels for closing the bottom of said container.

4. A collapsible multi-compartment container as defined in claim 3 in which said bottom panel closure means includes a bottom flap hinged to each of said outer side panels on an edge of each said outer side panel opposite to the cut line edge of an outer side panel.

5. A collapsible multi-compartment container as defined in claim 3 which further includes additional bottom panel closure means hinged to at least two of said end panels on the edges thereof opposite to the cut line edges of the end panels.

6. A collapsible multi-compartment container as defined in claim 5 in which said additional bottom panel closure means are hinged to each of said end panels.

7. A collapsible multi-compartment container as defined in claim 5 which said additional bottom panel closure means include a bottom flap hinged to each of said end panels on opposite sides of one of said outer side panels.

8. A collapsible multi-compartment container as defined in claim 7 in which each bottom flap extends laterally past said hinged connection to its associated end panel to a position adjacent a connection panel which is hinged to the associated end panel, thereby enabling the bottom flaps to extend beneath adjacent compartments when the single sheet is folded and erected into a multi-compartment container.

9. A collapsible multi-compartment container as defined in claim 5 in which said additional bottom panel closure means includes a bottom flap hinged to an end panel on one side of a first of the outer panels, and a bottom flap hinged to an end panel on the opposite side of the second of the outer panels.

10. A collapsible multi-compartment container as defined in claim 9 in which each bottom of flap extends laterally past said hinged connection to its associated end panel to a position adjacent said connection panel hinged to that associated end panel, thereby enabling the bottom flaps to extend beneath adjacent compartments when the single sheet is folded and erected into a multi-compartment container.

11. A collapsible multi-compartment container as defined in claim 2, in which the single sheet is folded and erected into a five-compartment container having pairs of smaller compartments separated by a larger compartment, and which further includes additional panel means for dividing said largest compartment of said erected container into two smaller compartments.

12. A collapsible multi-compartment container as defined in claim 11 in which a first slot is formed between said aligned and adjacent connecting panels in said left extensions and a second slot is formed between said alignment and adjacent connecting panels in said right extensions when the sheet is folded and erected, said slots being on opposite sides of said larger compartment, and in which said additional panel means includes a divider panel inserted in and extending between said opposing slots.

13. A collapsible multi-compartment container as defined in claim 11 in which said additional panel means includes an additional extension having one end attached to one of said adhesion panels of one of said extensions on one of said opposite edges of one of said outer side panels and having an opposite end adhered to one of said panels of said extension on the other of said opposed edges of said one outer side panel, said additional panel means being flat when the container is in the collapsed configuration but folding to divide said larger compartment when the container is erected.

14. A collapsible multi-compartment container, comprising;

(a) a pair of outer side panels each having a pair of opposed edges, and (b) an extension for each of said opposite edges of each of said outer side panels, (c) the two extensions for one of said outer side panels and one of the extensions for the other of said outer side panels each including an end panel, a connecting panel, a partition panel and an adhesion panel consecutively hinged from said two opposed edges of the one outer side panel and one of said opposed edges of the other side panel, (d) the extension for the remaining opposite edge of said other side panel including an end panel, a connecting panel, a partition panel, panel means for dividing a middle larger cell into two smaller cells, means for adhering said partition panel to said other outer side panel, and means for attaching said divider panel means to one of said panels extending from the opposite edge of said other outer side panel when the two extensions for said other outer side panel are folded toward each other, (e) said outer side panels and the extensions associated therewith being formed in a single sheet of material on opposite sides of a cut line in said sheet, said cut line being interrupted by means for forming hinges between aligned connecting panels of said extensions.

15. A collapsible multi-compartment container as defined in claim 14 which further includes panel means hingedly connected to at least one of said outer side panels for closing the bottom of said container.

* * * * *

UNITED STATES PATENT AND TRADEMARK OFFICE

CERTIFICATE OF CORRECTION

PATENT NO. : 4,756,469

DATED : July 12, 1988

INVENTOR(S) : Gerald M. Hansen

It is certified that error appears in the above-identified patent and that said Letters Patent is hereby corrected as shown below:

Col. 1, line 36, after "multi" (first occurrence), insert --(-)--.

Col. 7, line 55 (Claim 1), after "(a)". insert --a--

Col. 8, line 4 (Claim 1), change "(g)" to --(f)--; same claim, line 10, change "(h)" to --(g)--; same claim, line 14, change "(i)" to --h--.

Signed and Sealed this

Eighth Day of November, 1988

*Attest:*

*Attesting Officer*

DONALD J. QUIGG

*Commissioner of Patents and Trademarks*